US007833044B2

(12) United States Patent
Bouchan et al.

(10) Patent No.: US 7,833,044 B2
(45) Date of Patent: Nov. 16, 2010

(54) CONNECTION SYSTEM AND SQUIB CONNECTOR THEREFOR

(75) Inventors: Christophe Bouchan, Longjumeau (FR); Patrick Dechelette, Le Plessis Robinson (FR)

(73) Assignee: Molex Incorporated, Lisle, IL (US)

( * ) Notice: Subject to any disclaimer, the term of this patent is extended or adjusted under 35 U.S.C. 154(b) by 152 days.

(21) Appl. No.: 12/067,022

(22) PCT Filed: Sep. 19, 2005

(86) PCT No.: PCT/EP2005/010072

§ 371 (c)(1),
(2), (4) Date: Jun. 25, 2008

(87) PCT Pub. No.: WO2007/038939

PCT Pub. Date: Apr. 12, 2007

(65) Prior Publication Data

US 2009/0098758 A1 Apr. 16, 2009

(51) Int. Cl.
*H01R 13/627* (2006.01)

(52) U.S. Cl. ..... 439/352; 439/924.1

(58) Field of Classification Search ..... 439/350, 439/357, 358, 352, 924.1
See application file for complete search history.

(56) References Cited

U.S. PATENT DOCUMENTS 6,203,342 B1 3/2001 Gauker et al.
2001/0014558 A1* 8/2001 Tucker et al. ..... 439/676
2004/0005806 A1* 1/2004 Annecke ..... 439/358
2004/0248475 A1 12/2004 Seminara et al.
2005/0009390 A1* 1/2005 Barker et al. ..... 439/188

FOREIGN PATENT DOCUMENTS

DE 202 16 337 U1 12/2002
EP 0 952 636 A1 10/1999

OTHER PUBLICATIONS

International Search Report and Written Opinion.
Zhenyu Wang, "Chinese Office Action Application No. 200580051622.6", Nov. 20, 2009, Publisher: Chinese Patent Office.

* cited by examiner

*Primary Examiner*—Ross N Gushi
(74) *Attorney, Agent, or Firm*—Larry I. Golden

(57) ABSTRACT

The invention relates to a squib connector for mating with a squib holder and to a corresponding, connection system. system according to any of the preceding claims, said connector. The inventive squib connector is adapted to be used for an inventive connection system between a squib connector and a complementary squib holder, said connection system has one locking means (134, 135, 211) and one unmating means (180), said locking means being adapted to be automatically actuated by the consolidation of the squib connector with the squib holder for automatically and securely locking the squib connector and the squib holder in fully mated condition and to be deactivated by the selective actuation of the unmating means necessary for separating the squib connector and the squib holder.

29 Claims, 11 Drawing Sheets

CONNECTION SYSTEM AND SQUIB CONNECTOR THEREFOR

TECHNICAL AREA

The invention relates to a squib connector for mating with a squib holder or header connector holding the squib to supply the squib with electric energy for operating for example an airbag system and to a corresponding connection system.

STATE OF THE ART

Usually, in any condition in which a squib connector is not fully mated with a complementary squib holder and hence, is not fully connected to the squib thereof a shunt or shorting means mounted within the squib holder has to short-circuiting the contact terminals of the squib holder as an electrical protection. Only in case the squib connector is fully mated with the squib holder and hence, the contact terminals of the squib connector are fully connected to the contact terminals of squib the shunt is deactivated for the activation of the squib operating circuit, for example operating an inflator in response to electric energy supplied by the squib connector controlled by a control system.

Thus, in particular in case of using such a connector assembly for an airbag system a very sensible connection system has to be ensured, i.e. on the one hands side the fully mated condition between the squib connector and the squib holder connector must be very safe and on the other hands side, the connection should be very easy to handle with regard to the assembly and to the disassembly.

For example, for enabling a secure condition, connection systems for mating a squib connector and a squib holder connector are known, that provide first and second locking means. In these cases, the squib connector and the squib holder connector are consolidated during a first mating step into a pre-mated or not fully secured mated condition and than the second locking means has to be actuated by a second mating step in a position in which a fully secured mated condition is achieved thereby fixing the first locking means in its locking position by the actuation of the second locking means. Thus, by using first and second locking means a two-step mating process has to be performed. Moreover, even for disassembly the two connectors a two-step unmating process has to be performed, too.

It is also known to provide a locking means which however can be only inserted into its securing position after the squib connector and the squib holder have been fully mated but are still unsecured in this condition. Hence, a two-step mating process as well as a two-step unmating process have to be performed, too.

In case of providing a connection system for securely mating a squib connector and a squib holder connector by use of only one locking means and by a one-step mating process, the disassembly however, to date is very difficult or even impossible.

Moreover, even with regard to the shunt means a variety of complex structures are known for ensuring that the shunt is deactivated for the activation of the squib operating circuit only in case the squib connector is fully and securely mated with the squib holder connector.

As a consequence, even if a plurality of squib connectors and connection systems for mating such squib connector with a squib holder connector is known, many and further problems and drawbacks are involved therewith.

SUMMARY OF THE INVENTION

A main object of the invention is to provide a new and improved way of securely mating and unmating a squib connector and a squib holder easily.

The invention solution achieved by a connection system and by a squib connector comprising the features of claims 1 or 15.

Preferred and/or advantageous embodiments and refinements in particular for solving further objects are the subject matter of the remaining claims.

Accordingly, the invention proposes a connection system between a squib connector and a complementary squib holder, said connection system having one locking means and one unmating means, said locking means being adapted to be automatically actuated by the consolidation of the squib connector with the squib holder for automatically and securely locking the squib connector and the squib holder in fully mated condition and to be deactivated by the selective actuation of the unmating means for separating the squib connector and the squib holder.

Thus already by a correspondingly adapted squib connector to be used for such connection system no further assembly steps than just the consolidation of the squib connector and a squib holder are necessary for securely locking the squib connector and the squib holder in fully mated condition and hence, only a one-step mating process can be easily performed. Moreover, as the locking means also is automatically deactivated merely by separating the squib connector and the squib holder using a specific unmating means a one-step for the unmating is ensured, too. Moreover, any unwanted or unintentional unmating of the squib connector and the squib holder, i.e. without the selective actuation of the unmating means, is avoided.

A further object of the invention is to provide a secure activation and deactivation of a shunt mounted within the squib holder for short-circuiting or non-short-circuiting electrical contact terminals provided within the squib holder.

This object is solved in that said unmating means and said locking means are adapted to be in interacting relationship for deactivating shunt means of said squib holder in a non-shortening position only when the locking means is in the securely locking condition and the unmating means is deactivated. As a result, due to such interacting relationship it is ensured that the shunt means is being always in the shortening position if the squib connector and the squib holder is not in the fully mated operating condition and is deactivated in such mated operating condition.

For further enhancing the secureness in that said shortening circuit is activated automatically when the one-step unmating process begins and according to very preferred refinement said unmating means and said shunt means being adapted to cause a movement of the shunt means from the non-shortening position to a shortening position immediately upon the actuation of the unmating means.

Thus only in fully mated condition the shunt will be deactivated and will be activated just when the separation process begins to be activated.

Moreover, for avoiding any electrostatic discharge during the mating or unmating process, the invention proposes a squib connector having at least one ground terminal which is adapted to be connected with shunt means of the squib holder prior to the connection of contact terminals of the squib connector with the contact terminals of the squib holder during the mating process, to be connected with said shunt means as long as the squib connector and the squib holder being mated and to be disconnected from said shunt means only after the complementary contact terminals of the squib connector and the squib holder have been disconnected during the unmating process.

As very advantageous embodiments is it proposed an inventive connection system of which said squib connector having a housing defining a mating axis, a mating direction and a mating coupling side in such a manner that said locking means comprising at least one locking arm having a latch means being adapted for engaging perpendicularly to said mating axis complementary latch means provided by an area of said squib holder, each said locking arm being cantilevered attached to said housing, extending in the mating direction and providing a restoring force to be elastically bent by a force applied in a direction generally reverse to the engaging direction of said latch means, each said locking arm being adapted to be aligned to said squib holder area for axially abutting against said squib holder area during the consolidation, to define together with that squib holder area an inclined abutting interface there between for causing a force reverse to said engagement direction during the consolidation and to be at least partially released in response to the engagement of the latch means with the complementary latch means in fully mated condition.

Accordingly, by providing a cantilevered locking arm extending with its free end in the direction of a mating direction, wherein the free end has to be forced against an elastic restitution thereof until a latch means of said locking arm can engage in a released condition of said locking arm a complementary latch means a safety one-step mating process can be performed and in a force back effect is created as long as the locking arm is under mechanical stress and hence the squib connector will be ejected if not fully locked.

Preferably, said unmating means being supported in said housing, too, and being axially movable from the outside of the housing reverse to the mating direction from a first position to a second position, and complementary interacting cam means are provided between each said locking arm and said unmating means for applying a force to said locking arm reverse to said engagement direction in response to moving the unmating means from said first to said second position for disengaging said locking arm latch means out of said complementary latch means. Thus, by providing said unmating means as a movable actuator inside the housing, movable from the outside between a non-actuated and an actuated position and with a cam piece of the actuator also forcing the free end of the locking arm in said reverse direction in response to the activation of the actuator a very effective disengaging mechanism is provided to enable the unmating of the squib connector from the squib holder connector.

For the provision of an always defined interacting relationship said complementary interacting cam-means preferably are in loose engagement in said first position, i.e. non-actuated position, and are in full engagement in said second position, i.e. actuated position.

A very advantageous structural embodiment for avoiding any unwanted or unintentional unmating of the squib connector and the squib holder is achieved by a connection system, wherein each of said locking arm latch means and said complementary latch means being formed with a surface adapted for preventing axial separation, each said surface being planar and in a plane generally perpendicular to said mating axis at least during interengagement.

Preferably, each of the locking arm latch means and the complementary latch means can be formed hook-like. As an alternative or in addition each of the locking arm latch means and the complementary latch means can be formed at the free end of said locking arm male-like extending outwardly in radial direction and is adapted to be firstly mechanically stressed by said squib holder-area in response to the consolidation and then to be caught by said complementary latch means having a female-like groove.

According to further improved embodiments the inventive solution proposes a connection system, wherein the unmating means comprises for each said locking arm a corresponding unmating arm and said complementary interacting cam means are provided between each said locking arm and said corresponding unmating arm, wherein each of said unmating arm is joint to a bar means being in said first position generally aligned with a squib connector outer surface opposite to the mating coupling side but providing access for its actuation and/or wherein the unmating means has a shunt deactivating means, said deactivating means being adapted for pushing in response to said first position and to said fully mated condition a resilient short-circuiting contact portion of a shunt means mounted in said squib holder.

A further object of the invention is to provide a functionality for avoiding any damaging during mating of the squib connector with the squib holder connector.

Based thereon said mating coupling side of said squib connector is provided with a scoop-proof mating interface for the squib holder contact terminals to be electrically coupled with respective complementary contact terminals of the squib connector. Preferably, said mating interface comprises for each of said squib holder contact terminals a receptacle having a hemispherical drifting insertion opening, i.e. a kind of bullet nose shape, for guiding said squib holder contact terminals into said receptacle.

Based on the afore discussed inventive connection system a correspondingly adapted inventive squib connector ensuring corresponding advantages preferably has at least one locking arm being cantilevered attached to said housing, extending in the mating direction and providing a restoring force to be elastically bent by a force applied in a general inwardly radial direction with regard to said mating axis and has unmating means being supported in said housing and axially movable from the outside reverse to the mating direction from a first position to a second position with regard to said housing, wherein each said locking arm has latch means being adapted for securely engaging in a general outwardly radial direction complementary latch means of a squib holder in fully mated condition of the squib connector and the squib holder connector, each said locking arm being adapted to be automatically impact by a force applied in said inwardly radial direction in response to consolidating the squib connector and the squib holder and to be at least partially released in response to said fully mated condition for automatically interengaging said locking arm latch means with said complementary latch means of said squib holder in, and wherein complementary interacting cam means are provided between each said locking arm and said unmating means for applying a force to said locking arm in said inwardly radial direction in response to moving the unmating means from said first to said second position for disengaging said locking arm latch means in said fully mated condition.

Each of said cam means is advantageously provided by a V-like notch formed at the unmating means and by a kind of wedge formed at the locking arm, said V-like notch being open reverse to the mating direction and said apex or vertex of said wedge is directed in the mating direction. Preferably, said notch and said wedge being in loose engagement in said first position and said wedge has a radial outwardly offset to said notch in said first position.

According to further improved embodiments of the inventive squib connector, each said locking arm being adapted to axially abut against a squib holder area comprising said complementary latch means, and to form between said locking arm and said squib holder area at least one inclined abutting interface; each of said locking arm latch means being formed with a surface adapted for preventing axial separation during interengagement, said surface being formed to provide a plane generally perpendicular to said mating axis at least during interengagement; said unmating means comprises at least one protrusion adapted for only pushing in response to said first position and to said fully mated condition at least resilient short-circuiting contact portion of a shunt means mounted in said complementary squib holder for deactivating said short-circuiting contact portion, preferably said unmating means comprises for each said locking arm a corresponding unmating arm having respective one said protrusion adapted for pushing respective one resilient short-circuiting contact portion; said housing provides a scoop-proof mating interface for squib holder contact terminals to be electrically coupled with respective complementary contact terminals of the squib holder, preferably said mating interface comprises for each of said squib holder contact terminals a receptacle having a hemispherical drifting insertion opening for guiding said squib holder contact terminal into said receptacle.

Preferably in addition, the squib connector comprises at least one ground terminal having a dimension and/or configuration adapted to come into permanent contact with shunt means of the squib holder prior to the coupling of the complementary contact terminals of the squib connector and the squib holder. This avoids any electrostatic discharge inside the system which could ignite the pyrotechnic device.

According to further refinements, said inventive squib connector includes sealing means incorporated within said connector for sealing the interior. For achieving a fully sealed connector, in particular it is proposed that the sealing means comprises at least one sealing gasket arranged within the housing and/or preferably a silicone gel injected or assembled into the housing. Moreover, in addition a circular gasket is attached at the mating coupling side of the housing for interfacial sealing between the housing and the mated complementary squib holder.

Further objects and advantages of the invention will be apparent by the following more detailed description based on a preferred but exemplar embodiment and taking into account the accompanied drawings.

DETAILED DESCRIPTION OF A PREFERRED BUT EXEMPLARY EMBODIMENT OF THE INVENTION

In the following description a preferred but exemplar embodiment of a squib connector according to the invention is described based on the attached Figures.

Figure 1:
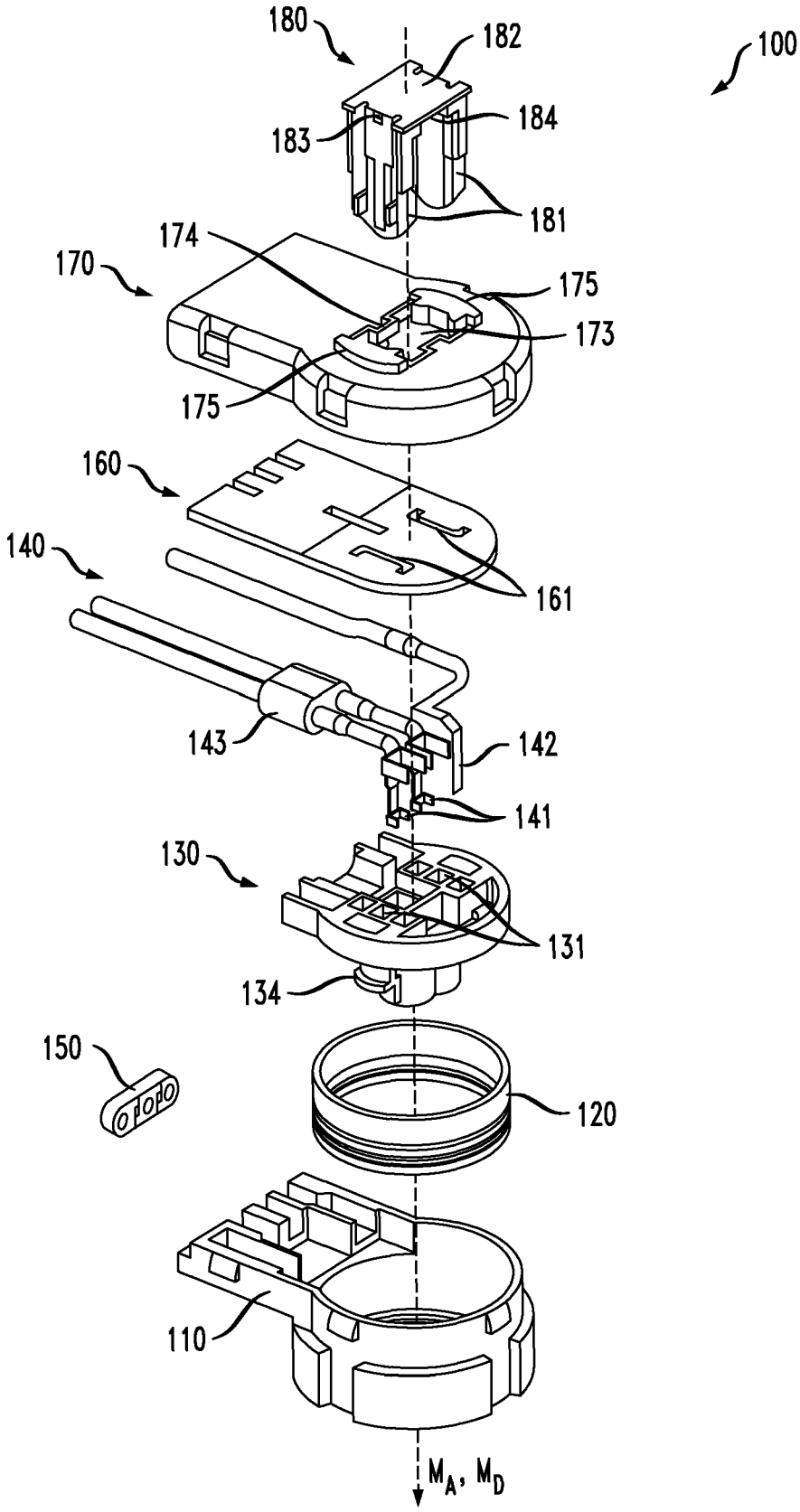
FIG. 1 is showing an exploded view of a preferred squib connector incorporating the invention, FIG. 2 showing the squib connector of FIG. 1 but with the squib connector components assembled together and seen from the mating coupling side of the squib connector, FIG. 3 showing the squib connector of FIG. 2 mated with a complementary squib holder, FIG. 4 showing a cross-section along the mating axis of the squib connector locked in fully mated and secured condition with a complementary squib holder and with an unmating means or actuator of the squib connector for separating being in a first or non-actuated position, FIG. 5 showing a cross-section according to FIG. 3 but with the actuator of the squib connector being pulled in a second or actuated position disengaging locking means for separating the squib connector and the squib holder, FIG. 6 showing a cross-section according to FIG. 4 but with the squib connector being additionally slightly lifted into a position of separation by further pulling the actuator, FIG. 7 showing a cross-section along the mating axis of the squib connector prior to be fully mated with a complementary squib holder and with the unmating means or actuator of the squib connector for separating being in the first or non-actuated position, FIG. 8 a more detailed sectional view of the interacting relationship between the unmating means and the locking means during fully mated connector condition and non-actuated actuator condition, FIG. 9 a more detailed sectional view of the interacting relationship between the unmating means and the locking means during fully mated connector condition and actuated actuator position for disengaging the locking means for separating the squib connector and the squib holder.

A such preferred but exemplar inventive embodiment of a squib connector is depicted in FIG. 1 in exploded view prior to the assemblage of several squib connector components.

In the Figures, the entire squib connector generally is referenced with 100 and a complementary squib holder or header connector holding the squib generally is referenced with 200.

Figure 2:
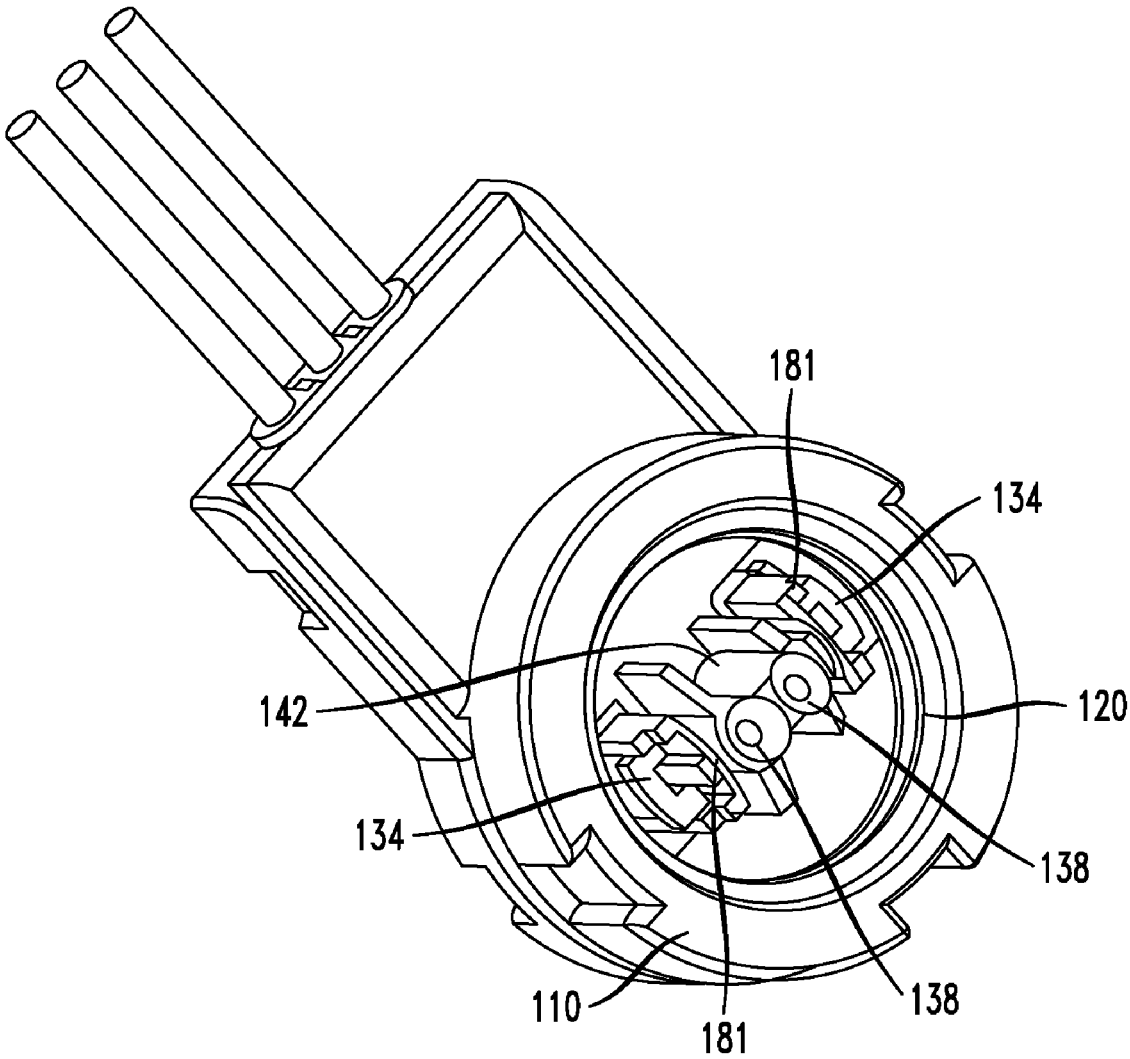
Figure 3:
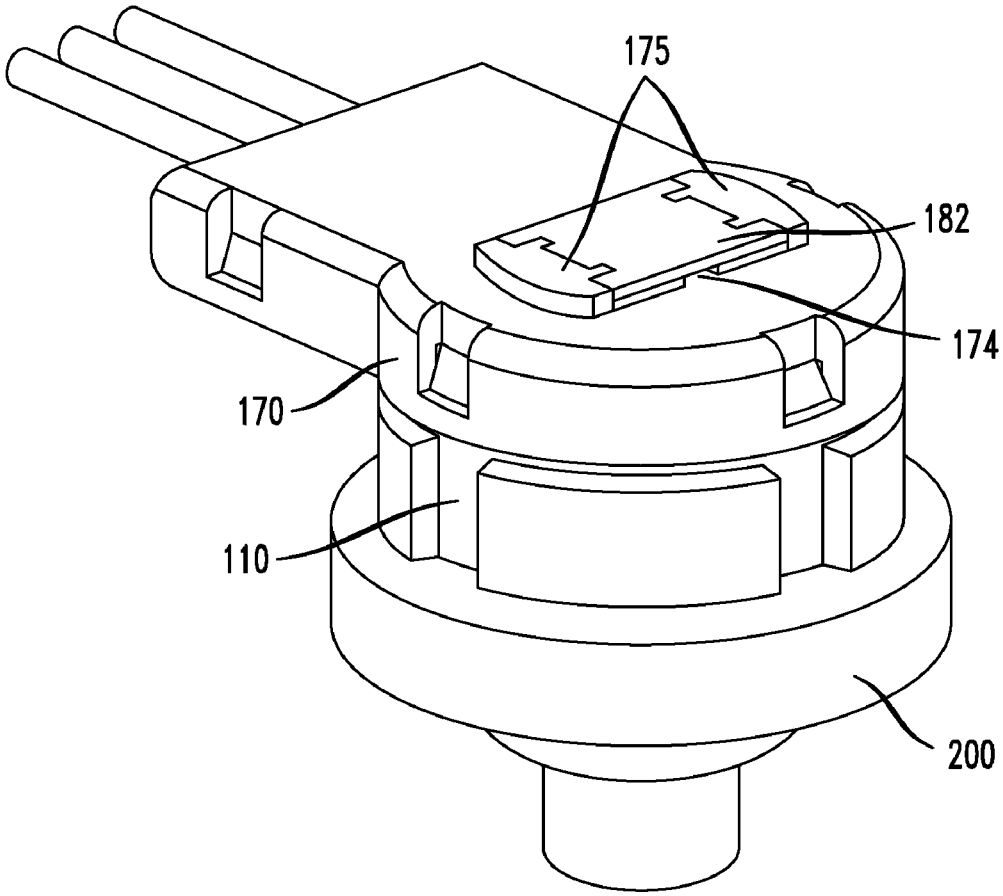

The squib connector 100 incorporates a connector housing comprising an outer connector main housing 110 supporting in principal all further squib connector components and covered by a cover 170. Opposite to the cover 170, the squib connector has a mating coupling side and the connector main housing 110 provides a mating opening, as can be seen in FIG. 2, for mating the squib connector with a complementary squib holder. The squib connector 100 mated with a complementary squib holder connector 200 can be seen in a general way for example in FIG. 3.

For the following description, the side from which the cover 170 is mounted to the connector main housing 110 is called upper side and the opposite side at which the mating opening being provided is called bottom side. The entire squib connector defines a mating axis $M_A$ and a mating direction $M_D$ leading from the upper side to the bottom side as it is shown in FIG. 1 by the dotted arrow.

Inside said connector main housing 110 an interfacial seal 120 enclosing the mating opening is mounted for sealing functionality between the squib connector 100 and the complementary squib holder when mated together. The sealing functionality between the squib connector 100 and the complementary squib holder 200 formed as kind of socket connector and provided by the afore mentioned arrangement of the interfacial seal 120 assembled within the connector main housing 110 can be seen for example in FIGS. 4 to 7. Based on FIG. 1, the interfacial seal 120 is inserted into the connector main housing 110 from the upper side.

However, even an insertion from the bottom side may be possible.

Preferably, a further insert connector housing 130 is attached within the connector main housing 110 for providing an application specific mating interface. The insert connector housing 130 is formed with through passages adapted for housing squib connector terminals 140.

Based on the embodiment, two terminals 141 of said squib connector terminals 140 being adapted for the electrical connection with complementary header pin terminals 400 of the squib holder and one terminal 142 of said squib connector terminals 140 being adapted as a ground terminal for the permanent electrical connection with a squib holder shunt means (not depicted) at least during the fully mated condition of the two connectors. The wires of the terminals 141 are engaged by a ferrite body 143. As can be seen from FIGS. 1 and 2 as well as from FIGS. 10*a*, 10*b*, 11*a*, 11*b* the ground terminal 142 has a length and is arranged within the squib connector and at its mating coupling side such that prior to the coupling of the contact terminals 141 with complementary contact terminals 400 (FIGS. 10*a*, 10*b*, 11*a*, 11*b* ) of a squib holder a permanent electrical connection between the ground terminal 142 and a corresponding shunt means or header ground terminal 350 (FIGS. 10*a*, 10*b*, 11*a*, 11*b*) can be provided for avoiding any electrostatic discharge inside the system which could ignite the pyrotechnic device.

Furthermore the insert connector housing 130 has two elastic locking arms 134 formed laterally at the insert connector housing 130 on opposite outer sides thereof, being part of a locking means and extending in mating direction $M_D$. Moreover parallel to the mating axis $M_A$, two through passages 131 are formed within the insert connector housing 130 adapted for the passing through of actuator arms 181. Each of the passages 131 is aligned to one of the locking arms 134 such that an actuator arm 181 passing through a passage 131 is positioned with regard to the respective aligned locking arm 134 with a slight inward-looking radial offset, as it can be seen in FIGS. 2, 4 to 9.

For improved sealing functionality of the inside of the connector main housing 110, an optional internal sealing gasket 160 is placed above the inserted terminals 140 onto the connector main housing 110. A wire gasket 150 is fitted around the terminal cabling and placed at cabling openings of the connector main housing 110 to ensure a sealed through passing of the cabling, as can be seen in FIG. 2, too. The internal sealing gasket 160 provides two through passages 161 axially aligned with the actuator arms through passages 131 of the insert connector housing 130, as can be seen in FIGS. 4 to 7, too. It should be mentioned, that in particular the wire gasket 150 and/or the internal sealing gasket 160 of the sealing components could be replaced for example by a silicon gel connector filling. Moreover, the sealing of the connector main housing even can be done by only using a silicone gel seal, in particular by using a gel having a correspondingly increased viscosity.

After the insertion of the housed components the cover 170 is mounted to the connector main housing 110. The outer surfaces of the cover 170 and the connector main housing 110 generally define the outer dimensions of the squib connector 100.

The cover 170 is formed with an opening 173 adapted to receive therein an unmating means providing an actuator 180 adapted for disconnecting or separating the squib connector 100 from the squib holder.

According to the described embodiment, the actuator 180 is U-formed and has two cantilevered arms 181 spaced from each other and extend from opposite ends of a joining base portion 182. In assembled condition of the actuator 180 within the connector housing by its insertion into the cover opening 173, the base portion 182 is supported within the opening 173 of the cover 170. The opening 173 and the arms 181 being aligned to said through passages 161 and 131 for leading through the free ends of the arms 181 in assembled condition.

Figure 4:
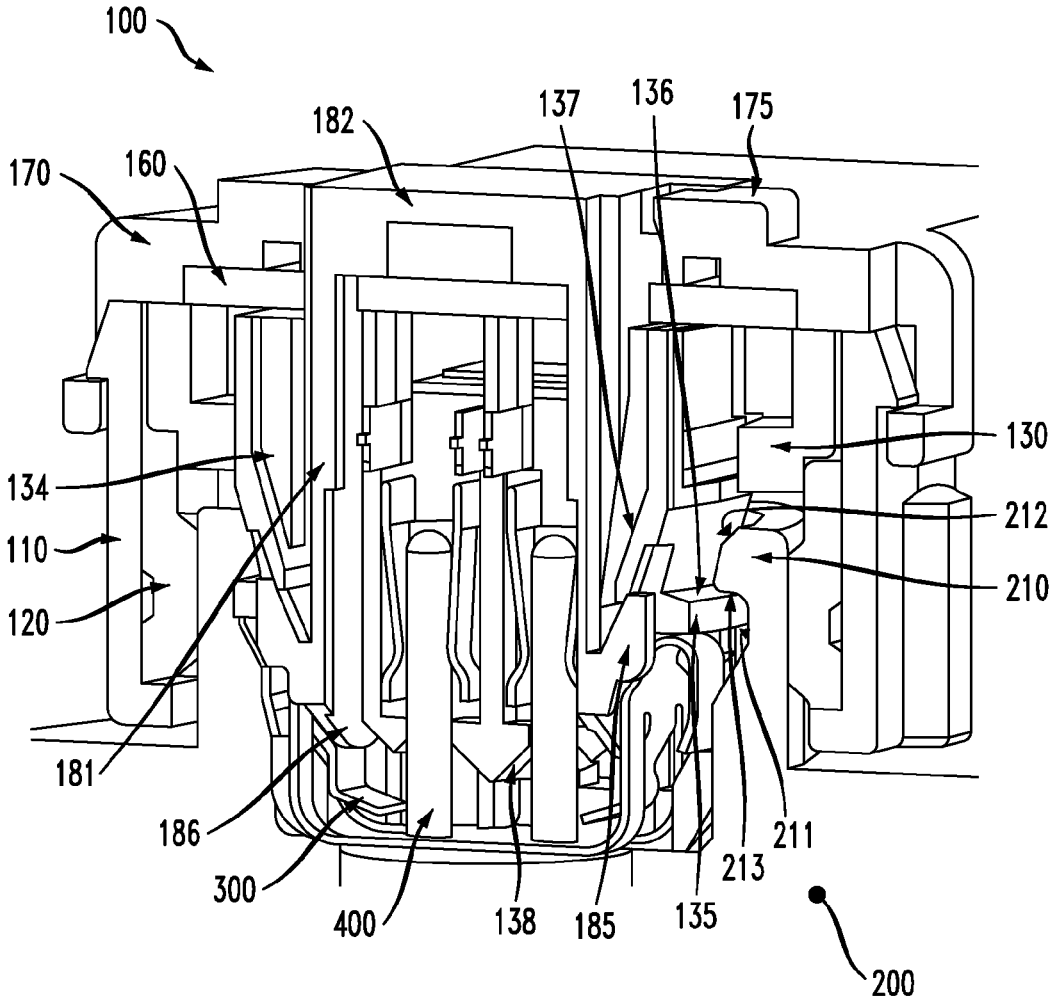
Figure 5:
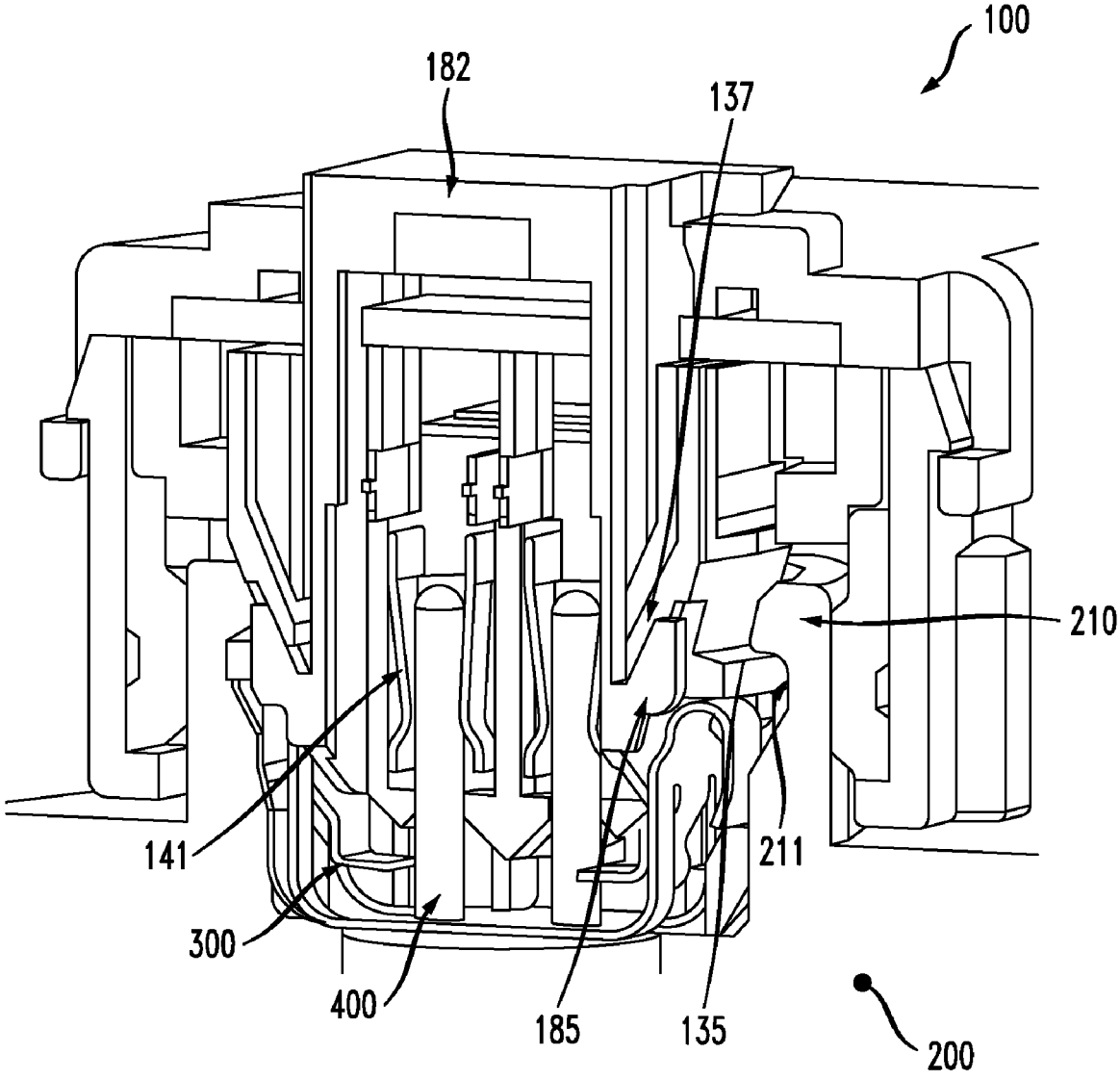
Figure 6:
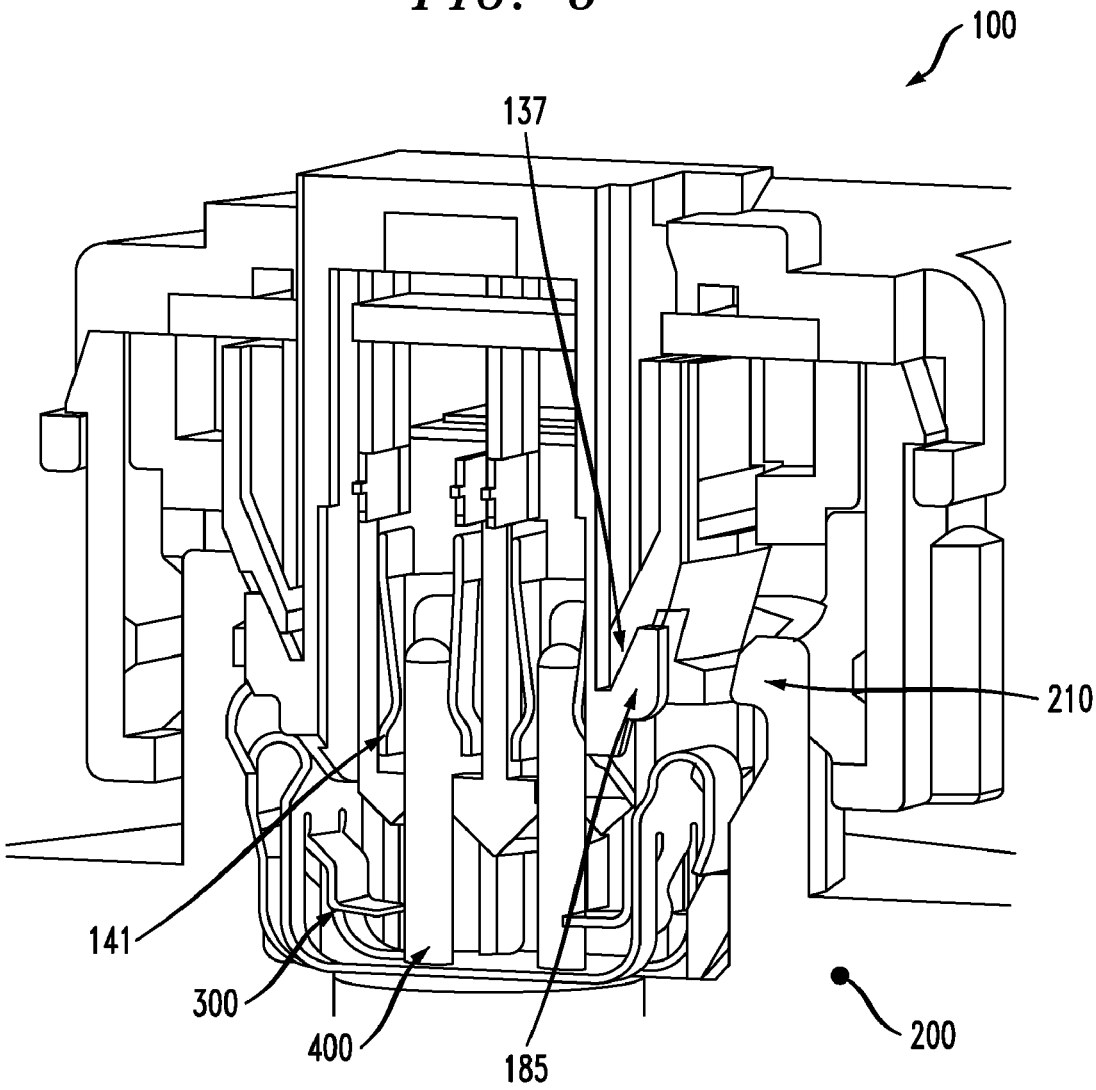
Figure 7:
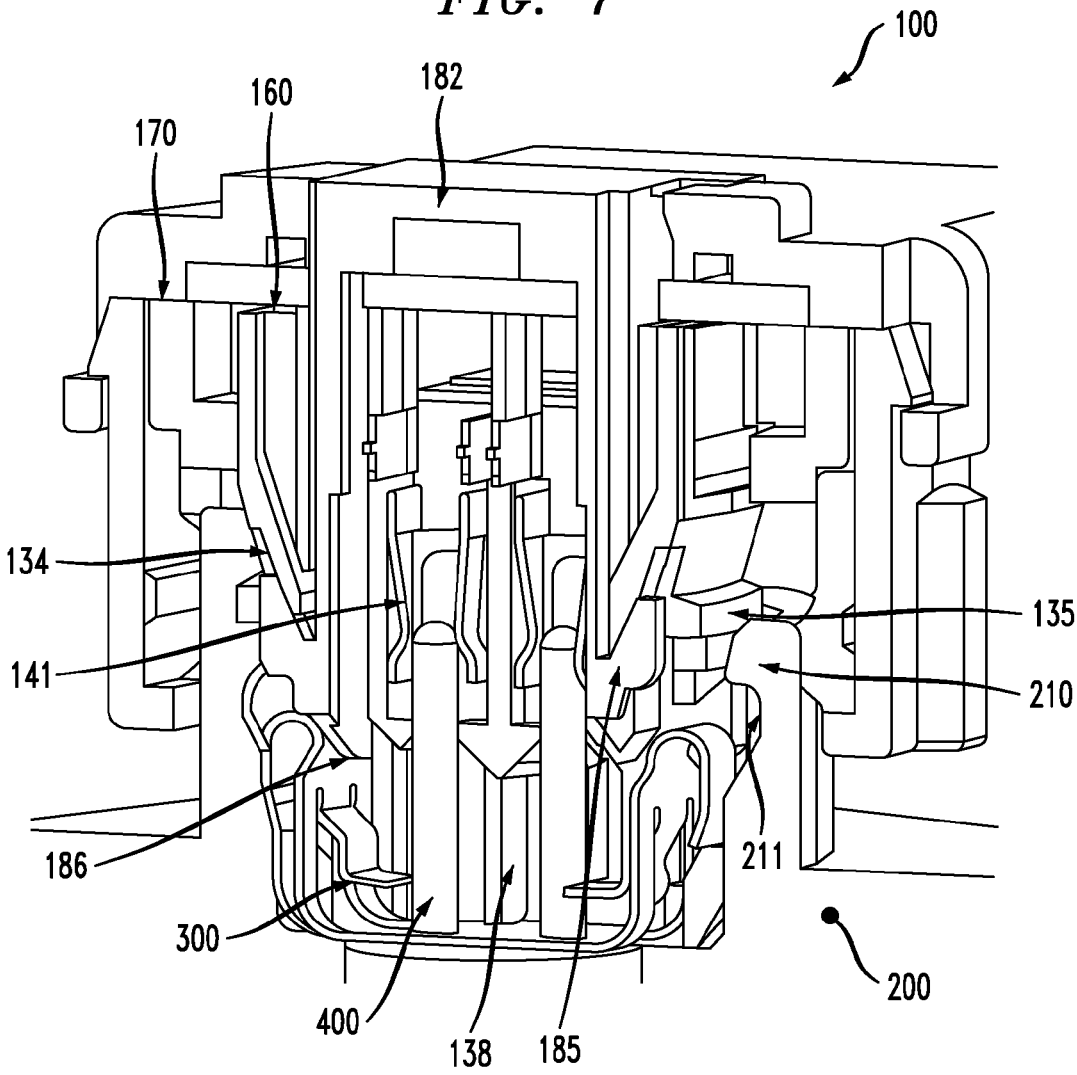

In the fully assembled and non-actuated condition of the actuator 180, the base portion 182 may rest on the sealing gasket 160, as can be seen in FIGS. 4 and 7. The actuation of the actuator 180 is performed, as described in more detail below, by pulling or lifting the actuator 180 somewhat out of the cover 170, i.e. in reverse direction with regard to the mating direction $M_D$, to a second position, as can be seen in FIGS. 5 and 6.

Thus for avoiding any unwanted actuation, in the assembled non-actuated condition of the actuator 180, the base portion 182 preferably is supported within the opening 173 such that the upper side of the base portion 182 is being flush with the upper side of the cover 170. For an easy actuation of the actuator 180 however, the opening 173 and/or the actuator 180 being adapted to provide an easy actuation access means for a wrench or a similar tool or even for fingers of a person. Therefore, in the depicted preferred embodiment of the inventive squib connector 100 and as can be seen in particular in FIGS. 1 and 3, the cover 170 is formed at its upper side with two salient protuberances 175 defining there between the opening 173. In assembled and non-actuated condition of the actuator 180 the opposite ends of the joining base portion 182 from which the cantilevered arms 181 extend rest against the salient protuberances 175 and snap means 183 at said the opposite ends interact with complementary means of the salient protuberances 175 for locating. The salient protuberances 175 of the cover 170 being adapted to provide an outer surface part of the cover flush with the outer surface of the basis 182 during the first or non-actuated position of the unmating means 180 in the connector housing. Thus, an easy actuation access means fingers of a person is provided. Moreover, opposite to the outer surface of the basis 182, i.e. at the inner side of the basis which faces the opening, a notch 184 is formed in the basis 182 and at least one nose 174 of the cover is slightly projecting into the opening 173. In inserted and non-actuated position of the actuator 180 within the connector 100 the notch 184 of the basis rests on the nose 174 such that an easy actuation access means for a wrench or a similar tool is provided, too.

The two cantilevered locking arms 134 of the insert connector housing 130 are adapted for automatically securing or locking a fully mated condition of the squib connector 100 and the complementary squib holder 200 upon said condition is reached during a one-step mating process forcing the squib connector onto or into the squib holder in fully mated condition.

Therefore, each of the cantilevered locking arms 134 extending in the mating direction $M_D$ has at its free end a latch means 135 extending perpendicular to the mating axis $M_A$ and being sized, located and aligned for engaging a complementary latch means 211 of the squib holder 200 and to be interlocked therewith upon fully mated together. Due to the cantilevered arrangement, the locking arms 134 provide a restoring force to be elastically bent by a force applied in a direction generally reverse to the engaging direction of said latch means 135.

According to the depicted embodiment and as can be seen in particular in FIGS. 4 to 9, each cantilevered locking arm 134 has at its free end a latch projection 135 extending in a general radial outward direction with regard to the mating axis $M_A$. The latch projection 135 being sized, located and aligned for engaging a complementary latch groove 211 of the squib holder 200 upon fully mated together, merely by consolidating the squib connector 100 and the squib holder 200.

As a consequence, the free end of the locking arm 134 has to be moved in a direction reverse to the extension of the latch projection 135 prior to lock a fully mated condition of the squib connector 100 with the squib holder 200. This is achieved by sizing, locating and aligning the locking arm 134 together with the latch projection 135 within the squib connector 100 for causing a correspondingly directed force during the mating process by the complementary squib holder 200.

FIG. 7 is showing a cross-section along the mating axis of the squib connector 100 prior to be fully mated with a complementary squib holder 200 and with the actuator 180 of the squib connector for separating being in the first or non-actuated position.

According to said embodiment, the locking arm 134 together with the latch projection 135 being sized, located and aligned for axially abutting with the latch projection 135 upon a counter profile 210 of the squib holder 200 during the mating process, wherein the latch groove 211 is formed at a defined axially distance from said point of abutment in mating direction $M_D$. At least one of the latch projection 135 and of the counter profile 210 is formed with an inclined abutting surface defining together with the mating axis $M_A$ an angle between 0° and 90°. According to the depicted embodiment the counter profile area 210 provides such an inclined surface 212. However, in addition or as an alternative, the bottom side surface of the latching projection 135 may be adapted as such an inclined abutting surface, for example.

Thus, due to the springy flexibility of the locking arm 134 however, the free end having the latch projection 135 can be forced in a radial direction inwardly, i.e. reverse to the extension of the latch projection 135, merely by further consolidating the squib connector 100 and the squib holder 200 for bypassing the counter portion 210 and hence, for enabling the passing of the locking arm 134 further along the mating direction $M_D$ down to the groove 211 of the squib holder 200 where the locking arm 134 is released again as the locking projection 135 engages the groove 211 and being caught therein.

Thus the counter portion 210 together with the groove 211 is defining a kind of hook and the free end of the locking arm together with the latch projection 135 is defining a kind of complementary hook, too.

Accordingly, during the one-step-mating-process the locking arms 134 are under mechanical stress condition on the squib header until the squib connector 100 is fully locked in final position on the squib header. As the force created thereby is directed not only in a radial and inward direction but also reverse to the mating direction the squib connector 100 will be ejected if not locked at 100%.

It is mentioned however, that even the free end of the locking arm can be provided with a groove extending inwardly radial and the squib holder is formed with a complementary latch projection.

Preferably, at least two locking arms 134 adapted for locking said fully mated condition are positioned at opposite lateral sides of the insert connector housing for avoiding any unintentional misalignment in said locked position.

For avoiding any unwanted-separation of the squib connector 100 and the squib holder 200 in fully mated condition each of said locking arm latch projection 135 being formed with an upper side surface 136 and said complementary latch groove 211 being formed with a surface 213 facing during interengagement the surface 136. Both of said surfaces being formed to provide a plane generally perpendicular to said mating axis at least during interengagement and hence, being adapted for preventing axial separation.

As a consequence, for unmating the squib connector 100 and the squib holder 200, the locking arm 134 has to be moved again-in the direction reverse to the extension of the latch projection 135 prior to unlock the fully mated condition of the squib connector 100 with the squib holder 200.

This is achieved by again deflecting the locking arm 134 inwardly to disengage the latch projection 135 from the recess or groove 211 by means of the activation of the actuator 180. The preferred mechanism between the actuator 180 and the locking arm 134 for unmating is described in the following.

Figure 9:
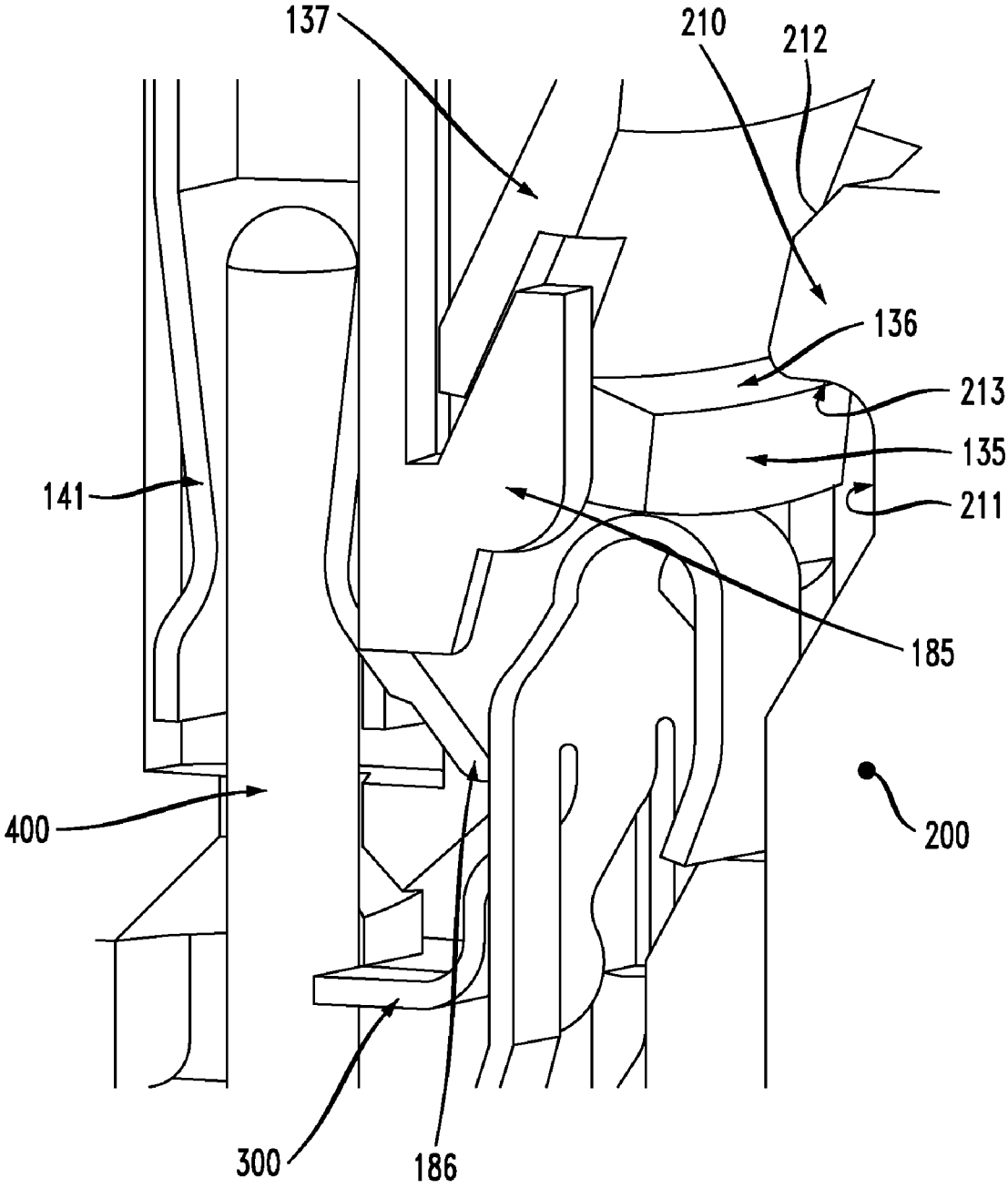

Said mechanism comprises complementary interacting cam-means between each said locking arms 134 and said respective actuator arms 181 that is in loose engagement in said first or non-actuated position of the actuator during the consolidation process (FIG. 7) and the fully and securely mated condition (FIG. 4, 8) of the squib connector 100 and the squib holder 200 and that is in full engagement in said second position or actuated position for the separation of the squib connector 100 and the squib holder 200 (FIGS. 5, 6, 9).

Figure 8:
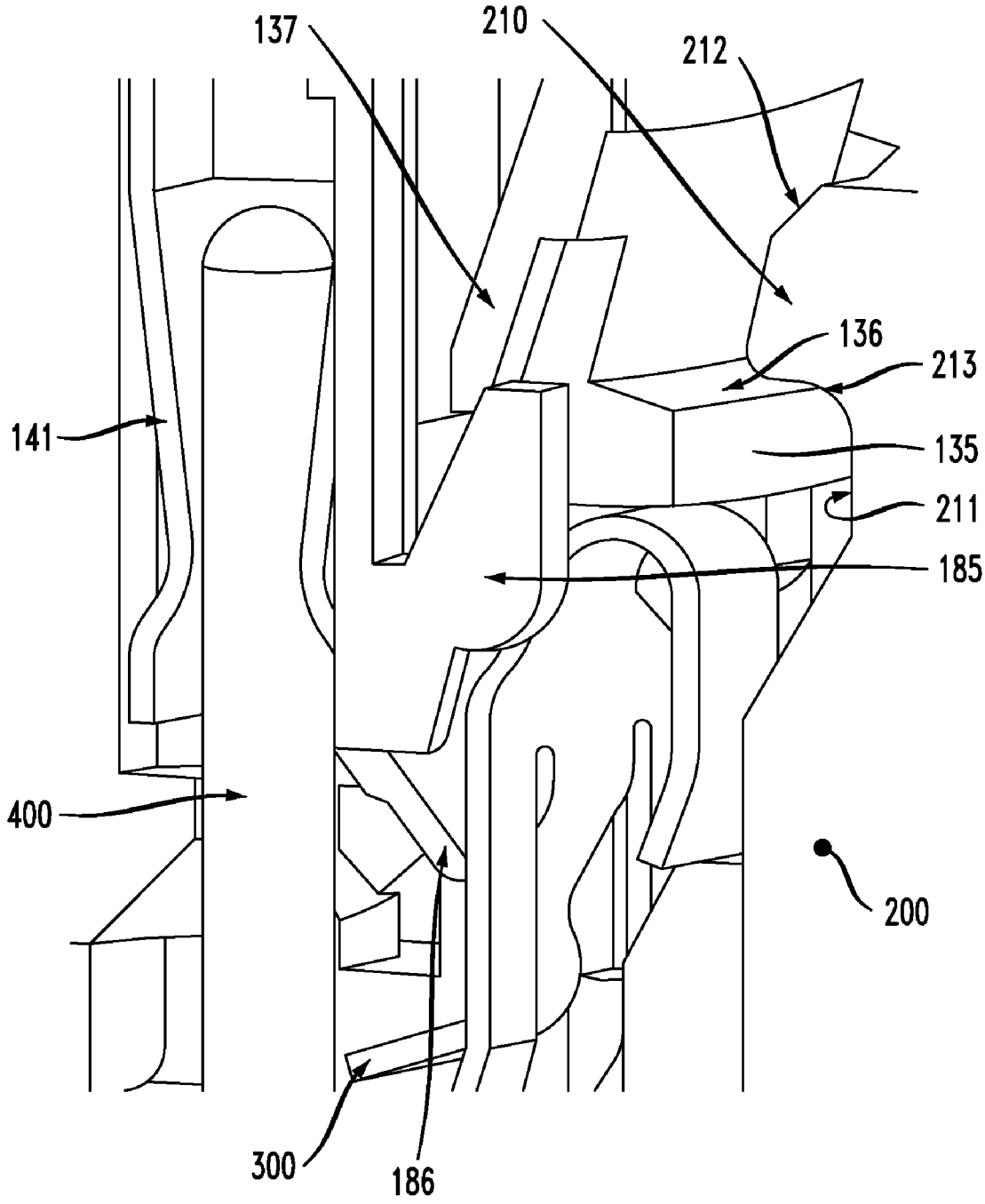

As can be seen in FIGS. 2 and 4 to 9 each actuator arm 181 is supported within the squib connector housing to affect a respective locking arm from the opposite side with regard to the squib holder area 211 during consolidation. Moreover, each actuator arm 181 extends more in direction of the mating direction $M_D$ than the locking arm 134. The free end of the actuator arm 181 is formed with a kind of V-notch 185, the V being open reverse to the mating direction $M_D$. The free end of the locking arm 134 is formed in addition to the latch projection 135 with a wedge-like shape 137 of which the apex or vertex is directed in the mating direction MD and aligned with the V-notch 185 but having a radial outwardly offset to said notch 185 as long as the actuator is in the non-actuated position (FIGS. 4, 7, 8). The dimensions of the actuator arms 181 and of the locking arms 134 are adapted to be in loose engagement with each other by means of said V-notch 185 and the wedge 137, substantially without influencing each other.

If the actuator 180 is pulled, as described above, the loose engagement between the V-notch 185 and the wedge 137 moves into an influencing engagement, i.e. the wedge 137 is received by the V-notch 185 as can be seen in FIGS. 5, 6 and 9, thereby pulling the free end of the locking arm 134 in radial direction inwardly and the latch projection 135 is pulled out of the recess 211 and enabling the bypassing of the latch projection 135 at the area 211 of the squib holder 200. As the wedge 137 and the V-notch 185 in released condition are slightly off-set from each other the locking arm 134 is pulled in said radial direction inwardly upon when the wedge 137 is received deeper within the V-notch 185. Thus, the actuator can be moved inside the squib connector housing only up to the second position and is then picking up the whole squib connector so that the entire unmating process can be performed only by pulling or activating the actuator 180.

To avoid any tilting of the locking arm 134 upon the activation of the actuator preferably to each lateral side of the locking arm a respective wedge 137 and V-notch 185 is formed.

Moreover, the free end of the actuator arm 181 has a prolonged protrusion 186 extending in the mating direction MD and sized for only deflecting in fully and secured mated condition a spring loaded shunt means 300 supported within the squib holder 200 to move it out of contact with a respective header contact terminal 400, as can be best seen in FIG. 8. Thus, just when the actuator 180 is activated for the separation of the squib connector 100 and the squib holder, i.e. is pulled slightly out of the cover 170 at the same time the protrusion 186 is moved back from the shunt means 300 and hence the shunt means is again contacting the contact terminal 400 for short-circuiting regions, as can be best seen in FIG. 9.

Figure 10A:
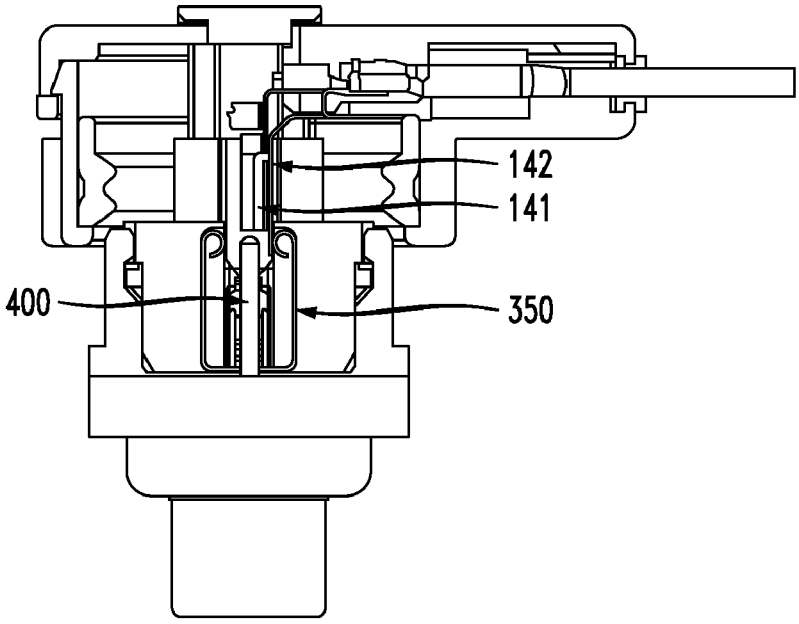
FIGS. 10*a*, 10*b* show partial cross-sections along the mating axis of the squib connector during an initial phase of mating process with a complementary squib holder, respectively seen from a slightly different perspective rotated around the mating axis.
Figure 10B:
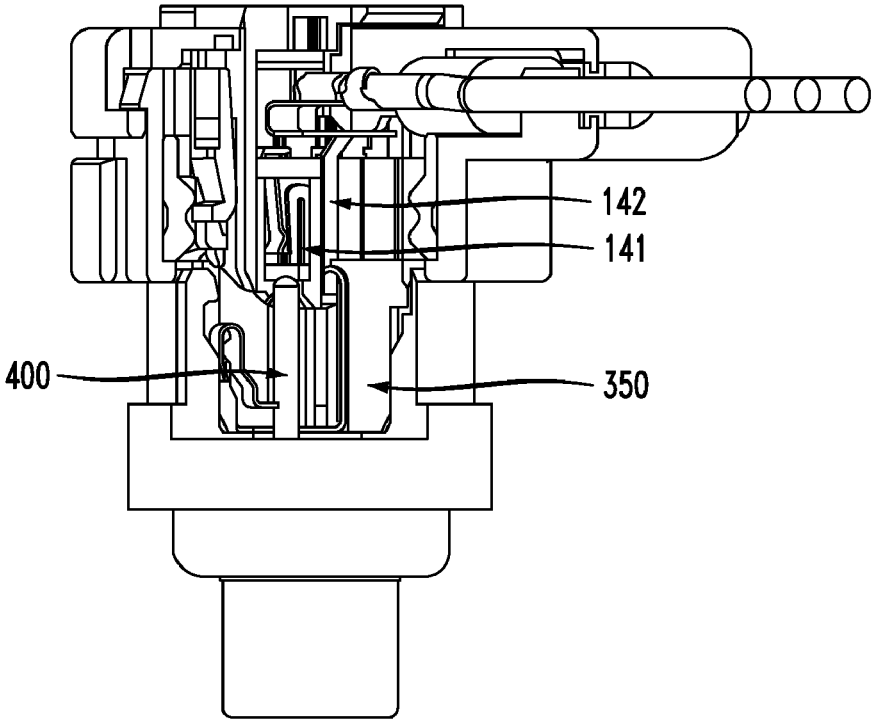
Figure 11A:
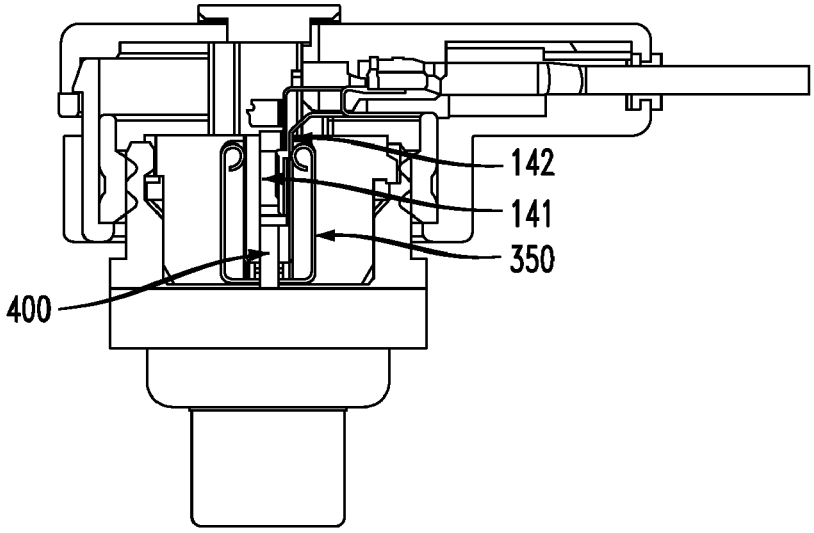
FIGS. 11*a*, 11*b* show partial cross-sections along the mating axis of the squib connector during a final phase of mating process with a complementary squib holder, respectively seen from the perspectives of FIGS. 10*a*, 10*b*.
Figure 11B:
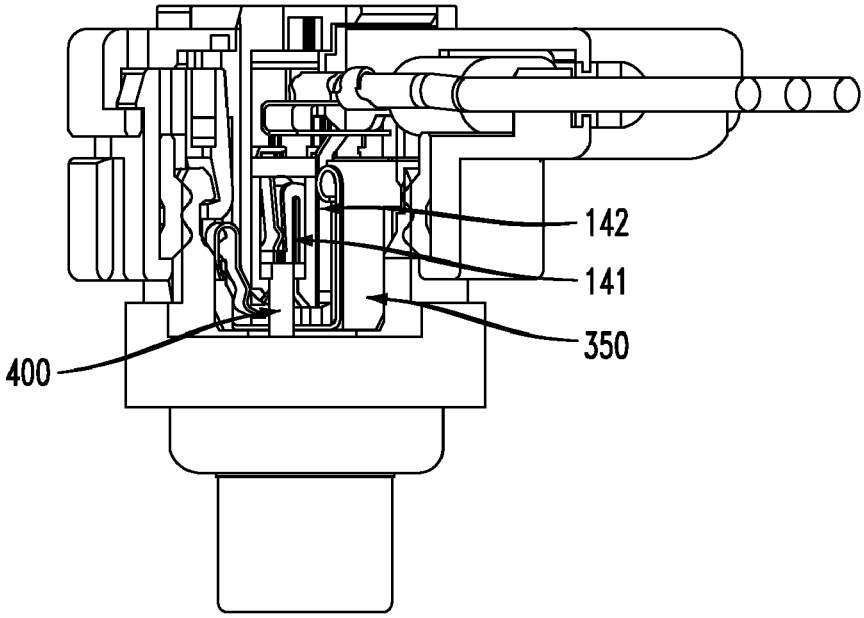

As a consequence, during the mating process the two header pins 400 of the squib holder 200 are short circuited by the spring-loaded shunt means 300 until the squib connector is securely and fully locked. The electrical contact however between the header pins 400 and the two connector terminals 141 is given prior to the fully locked position. Furthermore, as described above, prior to the electrical contact between the header pins 400 and the two connector terminals 141, the ground terminal 142 of the squib connector already is in permanent electrical contact with a corresponding shunt means part 350 of the squib holder. This can be seen in particular from FIGS. 10*a* and 10*b* showing an initial phase of the mating process from two different perspectives and from FIGS. 11*a* and 11*b* showing an final phase of the mating process from that two different perspectives. Thus, during the initial phase as depicted, electrical contact between the ground terminal 142 and a header ground terminal 350 is given but no electrical contact between the header signal pins 400 and the connector signal terminals 141. During the final phase as depicted, electrical contacts between the ground terminal 142 and a header ground terminal 350 as well as between the header signal pins 400 and the connector signal terminals 141 are given.

Moreover, the actuation of the actuator 180 causes a very early short circuiting of the terminal pins 400 of the squib holder as the protrusion 186 is releasing the spring loaded shunt means 300 prior to any disconnection of the contact terminals 140 from the header pin contact terminals 400. In addition, due to the preferred configuration of the ground terminal 142 of the squib connector, a full disconnection of the contact terminals 140 from the header pin contact terminals 400 is being performed prior to any disconnection of the permanent electrical contact between the ground terminal 142 of the squib connector and the corresponding shunt means part of the squib holder (not depicted).

Moreover, as can be seen from FIG. 2 the front or mating face of the insert connector 130 has a "bullet nose" shape provided by a respective scoop proof interface of the insert housing 130. In more detail passages for receiving the header pins 400 to be electrically coupled with the contact terminals 141 of the squib connector are provided with a chamfered inner mating surface or preferably a hemispherical drifting insertion opening 138 for guiding said header pins 400 into the passages and hence, to avoid damaging of the male pins 400 of the squib holder 200 during the mating process.

REFERENCE SIGNS

100 squib connector
- 110 outer connector main housing
- 120 interfacial seal
- 130 insert connector housing
  - 131 through passages
  - 134 locking arms
  - 135 latch means
  - 136 surface
  - 137 cam means
  - 138 opening
- 140 squib connector terminals
  - 141 terminals
  - 142 ground terminal
  - 143 ferrite body
- 150 wire gasket
- 160 sealing gasket
  - 161 through passages
- 170 cover
  - 173 opening
  - 174 nose
  - 175 salient protuberances
- 180 unmating means/actuator
  - 181 actuator arms
  - 182 base portion
  - 183 snap means
  - 184 notch
  - 185 cam means
  - 186 protrusion

200 squib holder
- 210 counter profile
- 211 latch means
- 212 inclined surface
- 213 surface

300 shunt means
350 header ground terminal
400 header contact terminals
$M_A$ mating axis
$M_D$ mating direction

We claim:

1. A connection system comprising:

a squib holder;

a squib connector for mating with said squib holder;

one locking means and one unmating means, the unmating means moveable between an activated and a deactivated position;

the locking means being adapted to be automatically actuated by the consolidation of the squib connector with the squib holder for automatically and securely locking the squib connector and the squib holder in fully mated condition with the unmating means in the deactivated position;

the squib holder having a shunt means and a header ground terminal;

the squib connector having at least one ground terminal which is adapted to be connected with the header ground terminal prior to the connection of contact terminals of the squib connector with the contact terminals of the squib holder during the mating process; and the ground terminal being connected with the header ground terminal as long as the squib connector and the squib holder are mated, and that a full disconnection of the complementary contact terminals of the squib connector and the squib holder occurs prior to disconnection of the ground terminal from the header ground terminal.

2. The connection system of claim 1, wherein the header ground terminal is connected to the shunt means.

3. The connection system according to claim 2, wherein the unmating means has a shunt deactivating means, said deactivating means being adapted for pushing in response to the first position and to the fully mated condition a resilient short-circuiting contact portion of a shunt means mounted in said the squib holder.

4. The connection system according to claim 2, wherein the squib holder comprises shunt-means for shorting the contact terminals mounted within the squib holder, and wherein the unmating means and the locking means are in interacting relationship for deactivating the shunt means in a non-shorting position only, when the locking means is in the securely locked condition and the unmating means is in the deactivated position.

5. The connection system according to claim 4, wherein the unmating means and the shunt means being adapted to cause movement of the shunt means from the non-shorting position to a shorting position immediately upon the actuation of the unmating means.

6. The connection system according to claim 2, wherein the squib connector having a housing defining a mating axis (MA), a mating direction (MD) and a coupling side;

the locking means comprising at least one locking arm having a latch means being adapted for engaging perpendicularily to the mating axis complementary latch means provided by an area of said squib holder;

each locking arm being cantilevered attached to the housing, extending in the mating direction and providing a restoring force to be elastically bent by a force applied in a direction generally reverse to the engaging direction of the latch means; and each locking arm being aligned to the squib holder area for axially abutting against the squib holder area during consolidation, the latch means having an inclined abutting interface between the squib holder area and the locking for causing a force reverse to said engagement direction during the consolidation and to be at least partially released in response to the engagement of the latch means with the complementary latch means in fully mated condition.

7. The connection system according to claim 6, wherein the unmating means being supported in the housing and axially movable from the outside of the housing reverse to the mating direction from a first position to a second position; and wherein complementary interacting cam means are provided between each locking arm and the unmating means for applying a force to the locking arm reverse to the engagement direction in response to moving the unmating means from the first to the second position for disengaging the locking arm latch means out of the complementary latch means.

8. The connection system according to claim 7, wherein the complementary interacting cam-means are in loose engagement in the first position and in full engagement in the second position.

9. The connection system according to claim 7, wherein the unmating means comprises for each locking arm a corresponding unmating arm and said complementary interacting cam means are provided between each locking arm and said corresponding unmating arm.

10. The connection system according to claim 7, wherein each of the unmating arm is joined to the unmating means being in the first position generally aligned with a squib connector outer surface opposite to the mating coupling side but providing access for its actuation.

11. The connection system according to claim 6, wherein each of the locking arm latch means and the complementary latch means being formed with a surface adapted for preventing axial separation, each surface is planar and is in a plane generally perpendicular to the mating axis at least during interengagement.

12. The connection system according to claim 6, wherein each of the locking arm latch means and the complementary latch means is formed hook-like.

13. The connection system according to claim 6, wherein the locking arm latch means has a male-like projection formed at the free end extending outwardly in radial direction and is adapted to be firstly mechanically stressed by the squib holder-area in response to the consolidation and then to be caught by the complementary latch means having a female-like groove.

14. The connection system according to claim 6, wherein the mating coupling side is provided with a scoop-proof mating interface for the squib holder contact terminals to be electrically coupled with respective complementary contact terminals of the squib connector.

15. The connection system according to claim 14, wherein the mating interface comprises for each of squib holder contact terminals a receptacle having a hemispherical drifting insertion opening for guiding the squib holder contact terminals into the receptacle.

16. A squib connector comprising:

a squib holder having a header around terminal and header contact terminals;

a housing having contact terminals and defining a mating axis, a mating direction and a mating coupling side;

wherein the housing has at least one ground terminal adapted to be connected with the header ground terminal of the squib holder prior to the connection of the contact terminals with the header contact terminals, and wherein a full disconnection of the complementary contact terminals from the header contact terminals occurs prior to disconnection of the ground terminal from the header around terminal.

17. The squib connector of claim 16, wherein the header ground terminal is connected to the shunt means.

18. The squib connector according to claim 17, wherein each locking arm being adapted to axially abut against a squib holder area comprising the complementary latch means, and forming at least one inclined abutting interface between the locking arm and the squib holder area.

19. The squib connector according to claim 17, wherein each of the locking arm latch means being formed with a surface adapted for preventing axial separation during interengagement, the surface being formed to provide a plane generally perpendicular to the mating axis at least during interengagement.

20. The squib connector according to claim 17, wherein the housing provides a scoop-proof mating interface for squib holder contact terminals to be electrically coupled with respective contact terminals of the squib connector.

21. The squib connector according to claim 20, wherein the mating interface comprises for each of the squib holder contact terminals a receptacle having a hemispherical drifting insertion opening for guiding the squib holder contact terminal into the receptacle.

22. The squib connector according to claim 17, wherein the connector includes a sealing means incorporated within the connector for sealing the interior.

23. The squib connector according to claim 22, wherein the sealing means comprises at least one sealing gasket arranged within the housing and/or a silicone gel injected or assembled into the housing.

24. The squib connector according to claim 17, wherein a circular gasket is attached at the mating coupling side of the housing for interfacial sealing between the housing and the mated complementary squib holder.

25. The squib connector according to claim 17, wherein the squib connector having at least one locking arm being cantilevered attached to the housing, extending in the mating direction and providing a restoring force to be elastically bent by a force applied in a general inwardly radial direction with regard to the mating axis;

an unmating means being supported in the housing and axially movable from the outside reverse to the mating direction from a first position to a second position with regard to the housing;

each locking arm has a latch means adapted for securely engaging in a general outwardly radial direction complementary latch means of a squib holder in fully mated condition of the squib connector and the squib holder connector;

each locking arm being adapted to be automatically moved by a force applied in the inwardly radial direction in response to consolidating the squib connector and the squib holder and to be at least partially released in response to the fully mated condition for automatically interengaging said locking arm latch means with the complementary latch means of the squib holder, and wherein complementary interacting cam means are provided between each locking arm and the unmating means for applying a force to the locking arm in said inwardly radial direction in response to moving the unmating means from the first to the second position for disengaging the locking arm latch means in the mated condition.

26. The squib connector according to claim 25, wherein each cam means is provided by a V-like notch formed at the unmating means and by a kind of wedge formed at the locking arm, the V-like notch being open reverse to the mating direction and an apex or vertex of the wedge is directed in the mating direction.

27. The squib connector according to claim 26, wherein the notch and the wedge being in loose engagement in the first position and the wedge has radial outwardly offset to the notch in the first position.

28. The squib connector according to claim 25, wherein the unmating means comprises at least one protrusion adapted for only pushing in response to the first position and to the fully mated condition at least a resilient short-circuiting contact portion of a shunt means mounted in the complementary squib holder for deactivating the short-circuiting contact portion.

29. The squib connector according to claim 28, wherein the unmating means comprises for each locking arm a corresponding unmating arm having respective one protrusion adapted for pushing respective one resilient short-circuiting contact portion.

* * * * *